United States Patent [19]

Abend et al.

[11] Patent Number: 4,833,465

[45] Date of Patent: May 23, 1989

[54] ELECTRONIC DOOR LOCK

[75] Inventors: Klaus Abend, Münster; Dieter Wienert, Senden; Johannes Filthaut, Sendenhorst, all of Fed. Rep. of Germany

[73] Assignee: Aug. Winkhaus GmbH & Co. KG, Fed. Rep. of Germany

[21] Appl. No.: 19,488

[22] Filed: Feb. 26, 1987

[30] Foreign Application Priority Data

Feb. 28, 1986 [DE] Fed. Rep. of Germany ..... 3606620

[51] Int. Cl.[4] ..... E05B 47/00

[52] U.S. Cl. ..... 340/825.310; 70/279; 70/413

[58] Field of Search ..... 340/825.31, 825.69, 340/825.72; 361/172; 70/DIG. 51, 279, 278, 277, 276, 413

[56] References Cited

U.S. PATENT DOCUMENTS

| | | | |
|---|---|---|---|
| 4,196,347 | 4/1980 | Hadley | 455/603 |
| 4,392,134 | 7/1983 | Lutz | 340/825.31 |
| 4,663,952 | 5/1987 | Gelhard | 70/278 |

FOREIGN PATENT DOCUMENTS

| | | | |
|---|---|---|---|
| 2250578 | 4/1974 | Fed. Rep. of Germany . | |
| 2851396 | 6/1980 | Fed. Rep. of Germany . | |
| 3006128 | 8/1981 | Fed. Rep. of Germany . | |
| 3125827 | 3/1982 | Fed. Rep. of Germany . | |
| 3218112 | 11/1983 | Fed. Rep. of Germany . | |
| 3517858 | 11/1985 | Fed. Rep. of Germany . | |
| 3507871 | 11/1985 | Fed. Rep. of Germany . | |
| 2395380 | 1/1979 | France . | |
| 2561703 | 3/1984 | France . | |
| 2553139 | 4/1985 | France . | |
| 2096687 | 10/1982 | United Kingdom . | |
| 2158870A | 11/1985 | United Kingdom | 70/278 |

*Primary Examiner*—Donald J. Yusko

*Attorney, Agent, or Firm*—Toren, McGeady & Associates

[57] ABSTRACT

The electronic door lock for an electronic key provided with an electronic store for a key word datum has a latch bolt (5) actuatable at least from the inside of the door by means of a handle and a bolt (7) which is lockable and unlockable by an electric drive device (35). A control circuit (81) formed especially as micro-processor reads the key word datum stored in the key, through the reading device (77), and controls the electric drive (35) in dependence thereon. The reading device (77) includes sensor elements (93, 95), especially pieco-electric elements by way of which the drive direction of the electric drive (35) is selectable by a key movement of short stroke. In order that the electronic lock may be opened manually in case of emergency, a mechanical lock cylinder (113) is provided by means of which the bolt (7) is uncoupled from the drive connection to the electric drive (35) and is bringable into a drive connection to the handle nut (23) actuating the latch bolt (5). Then by actuation of the door handle, in addition to the latch bolt (5) the bolt (7) can be unlocked. The data transmission between the reading device (77) and the electronic key takes place contactlessly by infra-red, like the working voltage supply of the key. The working voltage supply can however also take place through electric contacts.

30 Claims, 3 Drawing Sheets

ELECTRONIC DOOR LOCK

BACKGROUND OF THE INVENTION

The invention relates to an electronic door lock for an electronic key provided with an electronic store for a key word datum, with a latch bolt engaging in a keep plate and actuatable at least from the inner side of the door by means of a handle, a bolt movable out to lock in the keep plate, an electronically controllable locking mechanism for the bolt, a reading device for the key word datum of the electronic key and a control circuit controlling the locking mechanism in dependence upon the read key word datum.

A door lock of this kind is known. In the conventional manner it comprises a latch bolt which is opened from the inner side of the door by means of a handle. The bolt of the door lock is closable, similarly to a cylinder lock, by means of a twist knob from the inner side of the door. In place of a lock cylinder lockable from the outside of the door by means of a mechanical key, a twist knob is likewise provided on the outside of the door and is couplable with the internal twist knob through an electrically controllable coupling. The normally freely rotatable outer twist knob, when the coupling is engaged, permits manual actuation both of the bolt and of the latch bolt. The coupling is controlled by a control circuit in dependence upon the key word datum of an electronic key which can be read by way of a reading device of the lock. The known electronic lock differs as regards its operation from conventional mechanical locks since it must first be set with the electronic key into locking readiness and then locked by means of its twist knob.

Another known electronic door lock is based upon a conventional cylinder lock. It has a lock cylinder through which both the bolt and the latch bolt can be actuated by means of an inserted key. The lock cylinder is couplable through an electrically controllable coupling with the actuating mechanism of the lock and contains a reading device for the key word information stored in a store of the electronic key. A control circuit controls the coupling in dependence upon the read key word datum. From the outside of the door the lock is additionally overlockable by a mechanical key, so that it may be opened even in emergencies. In this known door lock the key, as usual in conventional door locks, must be turned through a comparatively large angle of rotation for the actuation of the bolt and the latch bolt. This is frequently felt to be uncomfortable, for example if the key is hanging together with a plurality of other keys on a key holder.

SUMMARY OF THE INVENTION

It is the problem of the invention to produce an electronic door lock which can be operated more comfortably than hitherto.

This problem is solved in accordance with the invention in that the reading device comprises a sensor device responding to two three-dimensionally different orientations of the electronic key and in that the locking mechanism comprises an electric drive device, controlled by the control circuit, for the unlocking and locking movement of the bolt and drives the bolt, in dependence upon the orientation of the electronic key detected by means of the sensor device, in the unlocking direction or in the locking direction.

Such a door lock makes use of the advantages of electronic locks, especially the possibility of increasing the lock security by making available a very high number of locking combinations and of being able to vary the key code without problem, even in master-key installations. By the electric motor drive, for example by an electro-magnet or an electric motor, however the operation of the door lock is considerably simplified, without the necessity however of departing from the conventional manner of operation of door locks. The electronic key is inserted into a keyhole-resembling reception passage of the reading device in which the unlocking or locking movement of the bolt is triggered by a mechanical movement. In departure from conventional electronic door locks however a comparatively small turning movement suffices for the controlling of the bolt.

The electronic key can have a form similar to that of a conventional mechanical flat key. It can however also have a fundamentally different form, for example a card form. For the controlling of the direction of movement of the bolt it can also be provided that the sensor device responds to the orientation of the key selected in the insertion of the key into the reading device. By way of example it can be provided that a key of card form is inserted into the reading device with the upper side upwards for unlocking and with the upper side downwards for locking.

In a preferred development it is provided that the drive device is also in drive connection with the latch bolt and drives the latch bolt in the opening direction when the bolt is controlled in the unlocking direction by means of the electronic key. This development is intended primarily for door locks which have a handle only on the inside, but not on the outside of the door. However this development can also be used in door locks where the latch bolt can be operated either from the inside or from the outside by means of a door handle and it can be used in configurations which dispense entirely with a door handle. The last-mentioned configuration is advantageous especially if the door lock is to be locked by keys of different entitlements. By way of example it can be provided that a first kind of electronic key can control solely the drive of the latch bolt, that is to say it cannot open the door lock when locked, while a second kind of key can control both the bolt and the latch bolt.

The drive device can have separate electro-motive drive systems, for example electro-magnets or electric motors, for the bolt and the latch bolt. In order however to minimise the construction expense it is expediently provided that the drive apparatus comprises a common electro-motive drive element which drives the bolt through a first gear connection and the latch bolt through a second gear connection. It is possible to use drive elements with comparatively low rated power if the second gear connection includes an idle-motion device which uncouples the latch bolt from the drive element when the bolt is in the outer position. This achieves the object that the drive element, for example the electric motor, acts upon the latch only when the bolt is withdrawn from the keep plate and expediently has reached its enclosed end position.

The gear connections can be lever gearings, toothed-wheel gearings or the like. Especially when toothed-wheel gearings driven by an electric motor are used, a sufficiently great power ratio can be achieved which can even overcome clamping forces exerted upon the bolt or the latch bolt for example by the keep plate. The combination of a rack gearing for driving the bolt with a lever transmission for driving the latch bolt has proved especially suitable, since thus with low constructive expense it is possible to realise the idle-motion device in the form of a cam driven by the rack gearing and acting upon the lever gearing.

The electronic door lock is preferredly equipped with an additional mechanical lock which overlocks the electronic lock in emergency situations by means of a mechanical key. Emergency situations can arise for example in the case of a defect of the electronic lock or in case of danger, for example a fire or the like. Since the electric drive would oppose great mechanical resistance to the direct actuation of the bolt, for example by means of the lock bit of a mechanical lock cylinder, in a preferred form of embodiment a coupling shiftable by means of the lock cylinder is provided which brings the bolt alternately into a drive connection with the electric drive device or into a drive connection with a door handle provided on the outside of the door. For example in forms of embodiment with exclusively manually drivable latch, the external door handle can be coupled constantly fast in rotation with a handle nut actuating the latch; the outer handle can however also have a spindle mounted rotatably in the handle nut which can be couplable with the latch through a coupling pin displaceably guided in the handle nut radially in relation to this spindle and displaceable by means of the lock cylinder. In the last-mentioned version the lock cylinder can be utilised with comparatively low construction expense both for switching over the drive connection of the bolt and for coupling the outer handle with the handle nut.

The coupling provided for switching over the drive connection of the bolt and controllable by the lock cylinder can be realised in an especially simple manner in that the electric drive device drives the bolt through a toothed wheel gearing having a plurality of toothed wheels meshing with one another in a gear train, where an intermediate gear wheel of the gear train is mounted on a guide part movable radially of its axis of rotation, which guide part holds the intermediate gear wheel in a first position in engagement with a gear wheel of the gear train driven by the drive element, for example the electric motor, and in a second position in engagement with a toothed segment of the handle nut. The lock cylinder normally blocks the guide part, which is initially stressed by means of a spring preferably towards the second position, in the first position in which the bolt is driven by the electric motor. In the locking of the lock cylinder the guide part is liberated, whereby the spring closes the drive connection of the handle to the bolt. The locking bit of the lock cylinder, in the course of the closing movement, can drive the coupling pin of the handle nut into the axis of the outer handle, so that the bolt can be manually unlocked by means of the outer handle. Here the drive stroke of the outer handle is so selected that it can completely open the bolt with one stroke. In certain cases the drive connection can comprise a freewheel device so that the bolt can be unlocked by repeated actuation of the outer handle.

The emergency unlocking function of the electronic lock can also be realised by other measures. In another advantageous development it is provided that the keep plate is mounted movably in the opening direction of the door on a lock frame of a mechanical lock, especially again a cylinder lock, in such a way that when the mechanical lock is unlocked it is liberated for the movement in the opening direction and when the mechanical lock is locked it is arrested by the bolt of the latter. The keep plate can for example be mounted pivotably on the lock frame of the mechanical lock, so that when the mechanical lock is unlocked it can hinge down and liberates the latch bolt and the bolt of the electronic lock independently of the locked position of the latter.

The electronic lock can be used for preference in combination with an alarm installation or even an installation monitoring the access of persons, since the control circuit, provided in any case and expediently formed as micro-processor, can be extended without problems to such functions. In so far as the electronic lock is connected to an alarm installation, it is preferably provided that with the mechanical lock which renders emergency opening possible there is associated an alarm-giving contact of the alarm installation which, independently of the locked position of the bolt of the electronic lock, triggers the alarm of the alarm installation on mechanical overlocking of the bolt. The alarm-giving contact responding to the locked condition of the mechanical lock and an alarm-giving contact responding to the locked condition of the electronically controlled bolt, if provided, can be used in connection with the alarm installation or the person access monitor plant, for the exploration of an actual locked condition. Thus data as to the locked condition of a plurality of locks can be brought together and for example displayed or documented at a central point.

The electronic lock can be used for preference in combination with an alarm installation comprising a block lock. In conventional alarm installations the block lock is used merely for priming or unpriming the alarm installation. In a preferred development of the lock according to the invention the block lock additionally controls the locking function of the electronic locks, that is on priming of the alarm installation through the block lock all groups, or even only predetermined groups of electronic locks are automatically locked, and on unpriming of the block lock these are automatically unlocked. In this case the alarm installation controls the electronic locks according to the control position of its block lock.

In order that the electronic lock may be especially versatile in use, the electronic key contains not only an electronic store but also an electronic control circuit, for example in the form of its own micro-processor. Mutually associated energy transmission elements on the key and the reading device ensure the working voltage supply of the key. For the transmission of the key word data infra-red light transmission elements and infra-red light reception elements are provided, preferably both on the key and on the reading device, in order to render two-directional data traffic possible. The optical infra-red data transmission, especially in multi-bit parallel form, is operationally reliable and trouble-proof. More especially incorrect functions, such as occur in the transmission of data through mechanical contacts, are avoided with this kind of contactless data transmission. For the working voltage supply to the key an optical energy transmission will preferably be used likewise, for example by the use of light-emitting diodes, preferably laser diodes, on the side of the reading device and photo-diodes on the key side. If the photoelectric current of one single photo-diode on the key side does not suffice for the operation of the store and control circuit of the key, it is also possible for several of these elements to be provided. The working voltage supply can however also take place through mechanical contacts, especially if it is a matter of contacts elongated in the direction of insertion of the key, which are plurally contacted by counter-contacts of the reading device. In a further variant of the electronic key in which the key is supplied with operating energy through optical elements, in the reding device a laser diode is provided which illuminates the end of a bundle of optical fibres arranged in the shank of the key. At the other end the optical fibres diverge from one another and illuminate several photo-diodes. In this way the high light power of the laser diode, generated in a relatively small area, can be distributed to several photo-diodes occupying relatively much space. Thus the photo-diodes can be accommodated at a favourable point, as regards design, of the key, for example in the handle.

In order to increase the operational reliability of the data transmission, an arresting device is expediently provided which holds the key fast in the reading device at least during the data transmission. The arresting device can work purely mechanically, for example in that in the reading position it holds the key fast mechanically, so that an increased mechanical resistance is opposed to be movement of the key. Electro-magnetically actuated locking devices are also especially suitable. Especially electrically controllable locking devices of the last-mentioned kind can be used to prevent undesired multiple actuations of the electronic lock, for example in that they hold the key fast in the lock over a predetermined time after insertion and ensure that for a renewed actuation of the lock a certain time must elapse, or the key must be withdrawn and inserted into the lock afresh.

The electronic key can have any desired form, for example that of a conventional flat key or a card. Since the surfaces of the flat key shank are frequently underdimensioned for the accommodation of the data and energy transmission elements, especially in the case of optical data and energy transmission, in one expedient development it can be provided that the key shank cross-section has essentially the form of an equilateral polygon, especially a triangle or hexagon. In this way the area usable for the accommodation of the data and energy transmission elements can be enlarged.

The sensor device can have a reception cylinder, mounted rotationally-elastically in the lock, for the shank of the electronic key, which cylinder on rotationally-elastic deflection actuates electric contacts for the generation of the directional commands. Especially small angles of deflection can be achieved if in place of electric contacts piezo-electric elements are used, especially if the piezo-electric elements are acted upon directly by the key. The piezeo-electric elements are provided in pairs, and when two pairs are used a distinction of a rotating movement of the key from an exclusively radial tipping movement is also rendered possible.

BRIEF DESCRIPTION OF THE DRAWINGS

Examples of embodiment of the invention are to be explained in greater detail below by reference to drawings, wherein.

DETAILED DESCRIPTION OF THE INVENTION

Figure 1:
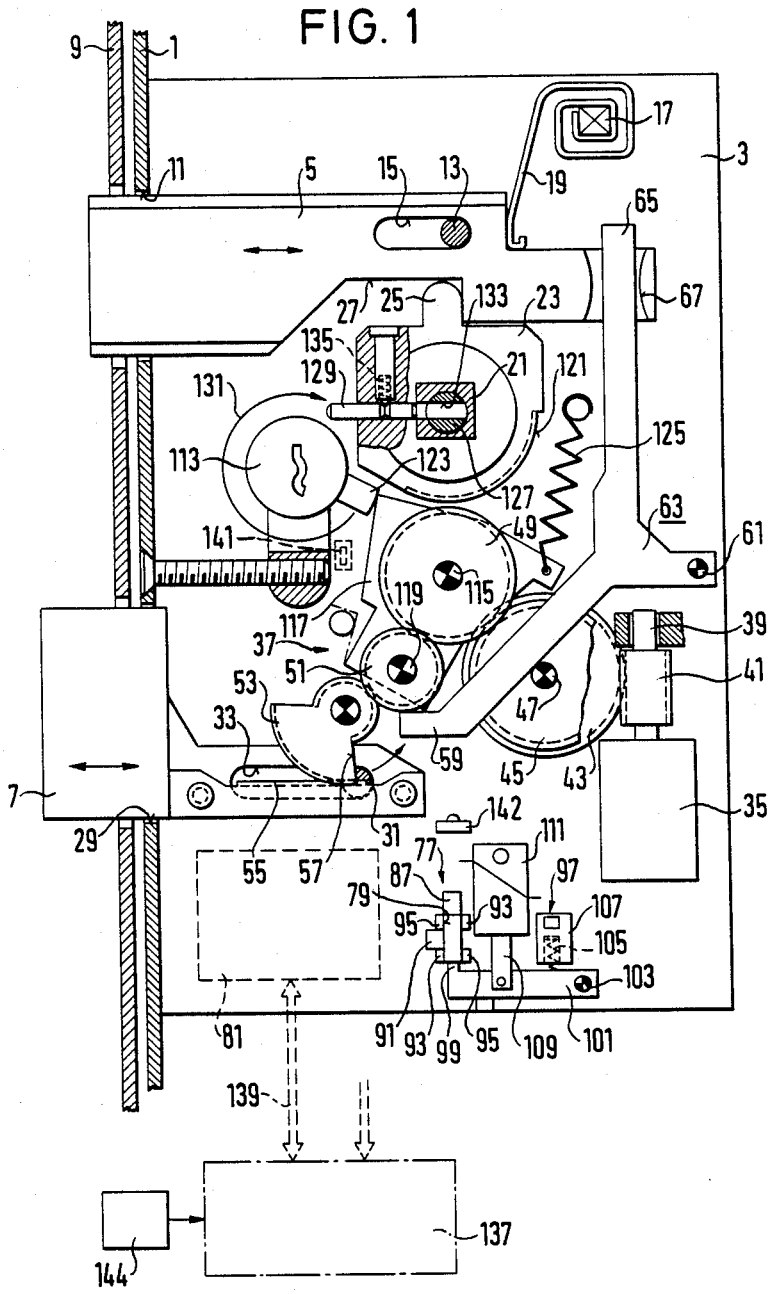
FIG. 1 shows a diagrammatic representation of an electronic lock.

FIG. 1 shows a door lock, formed as mortice dead lock, with a lock housing 3 closed off on one of its faces by a fit-over rail 1, in which a latch bolt 5 and a bolt 7 are guided displaceably transversely of the fit-over rail 1. The latch bolt 5 and the bolt 7 engage, when the door is closed, in a keep plate 9, according to the illustration in FIG. 1. The lock housing 3 is here installed in the door, while the keep plate 9 is secured to the door frame. The converse manner of installation with lock installed in the door frame and keep plate secure to the door leaf is likewise possible.

The latch bolt 5 is guided displaceably in an opening 11 of the fit-over rail 1 and on a housing-fast journal 13 which passes through a slot 15 of the latch bolt 5, and is initially stressed in the closing direction in the usual way by a spiral spring 19 held in shape-engaging manner on a square journal 14 fast with the housing. A handle (not shown further) arranged on the inside of the door is coupled fast in rotation in shape-engaging manner with a handle nut 23 pivotably mounted in the lock housing 3, through a square spindle 21. The handle nut 23 engages with a drive finger 25 in a coupling aperture 27 of the latch bolt 5, so that the latch bolt 5 can be opened from the inside of the door against the initial stress of the spiral spring 19 by a pivoting movement of the inner door handle.

The bolt 7 is guided displaceably in an opening 29 of the fit-over rail 1 and on a housing-fast journal 31 which passes through a slot 33 of the bolt 7, and is driven in both the opening and the locking direction by an electric motor 35 through a toothed wheel—rack gearing 37. A worm 41 seated on a shaft 39 of the motor 35 for this purpose drives a worm wheel 43 which is seated together with a toothed wheel 45 on a common spindle 47 mounted in the lock housing 3. The toothed wheel 47 meshes with a toothed wheel 49 which meshes with a toothed wheel 51 in turn, in a gear train. The toothed wheel 51 in turn meshes with a stepped segment toothed wheel 53, which engages in a rack 55 secured to the bolt 7 and moves the bolt 7 either in the unlocking direction or in the locking direction according to the direction of rotation of the motor 35.

When the bolt 7 is in the unlocked position the motor 35 also drives the latch bolt 5 in the opening direction. For this purpose the stepped segment toothed wheel 53 is provided with a cam shoulder 57 which, when the bolt 7 is unlocked, abuts on an arm 59 of a double lever 63 mounted on a spindle 61 pivotably on the lock housing 3. The double lever 63 engages with its other arm 65 in a drive opening 67 of the latch bolt 5 and drives the latch bolt 5 in the opening direction. The idle rotational distance between the cam face 57 and the arm 59 is dimensioned so that the bolt 7 is first drawn fully out of the keep plate 9 before the latch bolt 5 is driven. The motor 35 can thus be of slighter dimensions. The circumferential length of the toothing of the stepped segment toothed wheel 53 engaging in the rack 55 is so dimensioned that the toothed wheel 53 snaps out of the rack 55 during the actuating stroke of the latch bolt 5.

Figure 2:
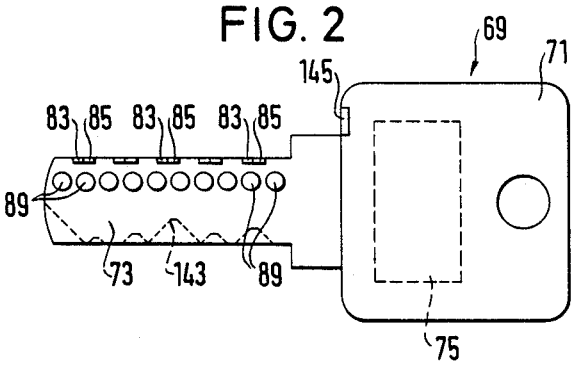
FIG. 2 shows a lateral elevation of an electronic key for the lock according to FIG. 1.

The electric motor 35 is controlled by an electronic key 69, represented in FIG. 2. The key 69 has the form of a flat key with a key handle 71, from which an elongated shank 73 protrudes. The handle 71 contains an electronic store and control circuit 75, for example a micro-processor, which stores a key word datum allocated to the key 69, in digital form. The lock in turn has a reading device 77 (FIG. 1), into the key passage 79 of which the shank 73 of the key 69 can be inserted. The reading device 77 reads the key word datum of the key 69 and compares it with a key word datum allocated to the lock and stored in a store and control circuit 81 of the lock. The store and control circuit 81 controls the motor 35 in dependence upon the key word information. The data transmission between the store and control circuits 75 and 81 takes place optically in both directions in bit-parallel form. For this purpose several pairs of infra-red light-emitting diodes 83 and infra-red photo-diodes 85 are arranged on a flat side of the shank 73 of the key 69, and opposite to them there lie in the key passage 79 of the reading device 77 corresponding pairs 87 of infra-red photodiodes and infra-red light-emitting diodes. In this way it is possible to transmit both data from the store and control circuit 81 to the store and control circuit 75 and data in the opposite direction. The locking security and the number of possible lock combinations can be considerably increased by the two-directional data traffic.

In standard formation the key 69 does not contain its own current source. For the operating voltage supply of the store and control circuit 75 a plurality of photo-diodes 89 is provided on one flat side of the shank 73, opposite to which light-emitting diodes 91, especially laser diodes, lie in the key passage 79 of the reading device 77. The photo-electric current generated by the illumination of the photo-diodes 89 feeds the circuit 75. The diodes 89, 91 also work preferably in the infra-red range. Trouble-free operation is achieved by the use of infra-red light for the data and energy supply of the key 69.

The direction of movement of the bolt 7 is controlled by a rotating movement of the key 69 inserted into the key passage 79. The reading device 77 comprises piezo-electric elements 93, 95 co-operating with the side faces of the shank 73 and subjected to action by pairs in dependence upon the direction of rotation of the key 69. The piezo-electric elements 93 and 95 respectively, allocated to the same direction of rotation, lie diametrically opposite to one another, so that they are claimed by opposite side faces of the shank 73. In FIG. 1 by way of example the piezo-electric elements 93 control the unlocking direction, while the elements 95 control the locking direction of the bolt 7. The circuit 81 detects the coincidence of the pressure charging of the piezo-electric elements 93 for the one part and the coincidence of the pressure charging of the elements 95 for the other part, so that the rotating movement of the key 69 can be distinguished from a tilting movement in which elements 93 and 95 in each case would be charged with pressure in common. The rotational stroke of the key for controlling the bolt movement is comparatively small, which facilitates the operation of the lock.

In order to preclude errors in the data transmission between the circuits 75 and 81 and to preclude undesired multiple controlling of the lock, a locking device 97 is allocated to the reading device 77 and under control of the store and control circuit 81 holds the key shank 73, when inserted into the key passage 79, fast at least during the data transmission but preferably also for a predetermined period thereafter. The locking device 97 has a lever 101 engaging with a finger 99 in the key passage 79 and co-operating with the shank 73 for its locking, which lever 101 is mounted pivotably on a spindle 103 fast with the housing amd is initially stressed away from the key passage 79 by a spring 105 which is seated in a spring mounting 107 fast with the housing. Upon the lever 101 there acts an armature 109 of an electro-magnet 111, which under the control of the circuit 81 draws the lever 101 into engagement with the shank 73 for the fixing of the key 69.

In emergency situations, for example on failure of the electronics or of the bolt drive, the electronic lock can be overlocked by a mechanical lock cylinder 113 lockable by a mechanical key and the bolt 7 can be unlocked together with the latch bolt 5 by actuation of the door handle. The lock cylinder 113 here controls the drive connection of the bolt 7 to the handle nut 23. The toothed wheel 49 is mounted on a spindle 115 which is held on a guide part 117. The guide part 117 is mounted pivotably coaxially with the axis 119 of the toothed wheel 51 on the lock housing 3, so that the toothed wheel 49, which is continuously in engagement with the toothed wheel 51 is bringable alternately into engagement with the toothed wheel 45 or a toothed segment 121 of the handle nut 23. The lock cylinder 113 has a bit 123 which, in the position intended for electric operation of the bolt 7 and represented in FIG. 1, rests on the guide part 117 and holds the toothed wheel 49 in engagement with the toothed wheel 45 driven by the motor 35. On locking of the lock cylinder 113 by means of the mechanical key (not shown further) the bit 123 liberates the guide part 117. A tension spring 125 stretched in between the lock housing 3 and the guide part 117 brings the toothed wheel 49 out of engagement with the toothed wheel 45 and into engagement with the toothed segment 121 of the handle nut 23. By rotation of the handle nut 23 in the opening direction of the latch bolt 5 the bolt 7 is driven in the unlocking direction, through the gear train of the toothed wheels 49 and 51 and the stepped segment toothed wheel 53. At the same time the latch bolt 5 is opened.

So that in case of danger the lock can also be opened from the outside of the door, on the outside of the door too a handle (not further illustrated) is provided which however is rotatably mounted coaxially with the handle nut 23 on a cylindrical spindle. The cylindrical spindle 127 is seated in a bore of the square spindle 21 of the inner door handle and can be coupled with the handle nut 23 through a radially displaceable coupling pin 129. The coupling pin 129 protrudes from the handle nut 23 into the pivot zone of the bit 123 of the lock cylinder 113. In its pivoting movement (arrow 131) liberating the guide part 117 the bit drives the coupling pin 129 into an opening 133 of the spindle 127 of the outer door handle and couples the outer door handle fast in rotation with the handle nut 23. A detent spring device 135 holds the coupling pin 129 normally out of engagement with the cylindrical spindle 127, in order to prevent undesired coupling of the outer door handle with the handle nut 23.

In a variant of the door lock the outer door handle can also constantly be coupled fast in rotation with the handle nut 23, for example through an axial prolongation of the square spindle 21. In this version the latch bolt 5 can be opened manually either from the inside or from the outside of the door. The coupling pin 29 and the detent spring device 135 can be eliminated. In the last-mentioned configuration the double lever 63 may also be eliminated if the possibility of opening the latch bolt 5 together with the bolt 7 by motor is waived.

The electronic door lock is especially suitable for use in combination with an alarm installation and/or an installation monitoring the access of persons, as indicated at 137 in FIG. 1. A data connection 139 exists between the store and control circuit 81 and the alarm and/or person access monitor installation 137. More especially this connection can be used to trigger an alarm in the case of mechanical overlocking of the electronic lock. The electronic lock for this purpose contains an alarm contact indicated at 141 which is actuated in dependence upon the overlocking movement of the lock cylinder 113 for example by its bit 123 or the guide part 117, alarm being triggered thereupon. For the monitoring of access of persons data of the key inserted into the key passage 79 in each case can be communicated by way of the reading device 77 to the installation 137. The alarm contact 141 and possibly an additional alarm contact 142 responding to the position of the bolt 7 permit, through the alarm installation 137 and/or the person access monitor installation, the central detection of the locking conditions of several electronic locks. The locking condition can be displayed optically or recorded for doucmentation. The alarm contacts 141, 142 can be interrogated here permanently or periodically, or possibly only on call from the control centre. The alarm installation 137 is controllable through at least one block lock 144, that is can be primed or unprimed. In a preferred example of embodiment the alarm installation 137 controls the electronic locks in dependence upon the position of the block lock 144, the electronic locks being locked through the bolt drive systems on priming of the alarm installation 137 and unlocked on unpriming of the alarm installation 137. In this case all doors, or even only groups of doors, can be locked according to the concept of the block lock installation.

The drive system design of the electronic lock is not limited to the drive connections as represented in FIG. 1. In place of the guide part 177 formed as pivot lever a guide part guided linearly displaceably on the lock housing 3 can be used. Other lever constructions or even toothed wheel gearings can be used for the motor drive of the latch bolt. If the rotational stroke of the handle nut does not suffice for a complete unlocking movement of the bolt, a freewheel arrangement can be arranged in the drive path provided for emergency opening, so that the bolt can be opened by repeated pressing of the door handle. The electronic lock is represented as a mortice dead lock; it can also be formed as attached lock. In this variant it can especially also be used in combination with a conventional cylinder lock, for example in that the toothed wheel gearing 37 does not directly drive the bolt 7 but the rotating movement of a lock cylinder engaging in the conventional cylinder lock. The lock cylinder controls the latch bolt and the bolt of the conventional cylinder lock.

The working voltage of the electronic lock is expediently supplied through a cable from the door frame, passing by way of a flexible cable transfer in the region of the door hinge from the case frame to the door leaf. Alternatively however it is also possible to provide for the working voltage supply resilient door contacts which abut on one another when the door is closed. Contactless energy transmission is also suitable, especially through an infra-red light-emitting diode or laser diode on the door frame and a photo-diode on the door leaf.

FIG. 2 shows further details of the electronic key. Even though the key needs no key notches, nevertheless key notches can be provided, as indicated at 143. Thus the key can be used additionally for locking mechanical cylinder locks. This is advantageous for example in master key installations in which the mechanical locking properties of the key can be utilised for locking generally accessible doors, for example of washrooms or the like.

On the handle 71 of the key 69 an infra-red light-emitting diode 145 or a laser diode can be provided additionally which can be used, through the store and control circuit, for remote operation, for example of a garage door. However for this use the key 69 must comprise an additional battery and a control element, for example a press button.

Figure 3:
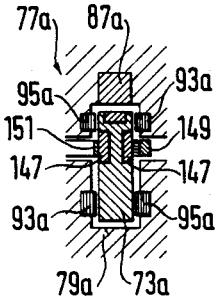
FIG. 3 shows a variant of a reading device for the lock according to FIG. 1.
Figure 4:
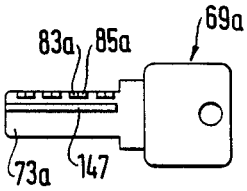
FIG. 4 shows a lateral elevation of an electronic key usable in combination with the reading device according to FIG. 3.

FIGS. 3 and 4 show a variant of a reading device **77*a* of the electronic lock and of the pertinent key 69*a*, differing from the reading device and key of the lock according to FIGS. 1 and 2 merely in the nature of the working voltage supply. Parts of like effect are therefore provided with the reference numerals of FIGS. 1 and 2 and with the letter a for distinction. For more detailed explanation of the assembly and manner of operation reference is made to the description of FIGS. 1 and 2**.

The energy voltage supply takes place through electric contacts. On the shank **73*a* of the key 69*a*, on the mutually opposite flat sides, contact paths 147 elongated in the longitudinal direction of the shank are provided, with electric insulation from one another, which are contacted by contact elements 149, 151 of the reading device 77*a* when the shank 73*a* is inserted into the key passage 79*a*. As represented for the contact 149, the contacts of the reading device 77*a* can be formed as electric brushes, or they may be spring tongues as represented for the contact 151. The contacts 149, 151 can be of like nature and lie preferably on the contact path 147 at several points distributed in the longitudinal direction. Especially when spring tongues are used, spring tongues elongated in the longitudinal direction of the shank can be used. For the data transmission the reading device 77*a* again comprises photo-diode/light-emitting diode pairs 87*a*, to which there are allocated light-emitting diode/photo-diode pairs 83*a*, 85*a* of the key 69*a*. Again piezo-electric elements 93*a*, 95*a* are provided in the reading device 77*a*** for the control of the direction of movement of the bolt.

Figure 5:
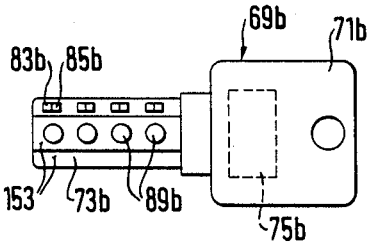
FIG. 5 shows a lateral elevation of a variant of an electronic key.
Figure 6:
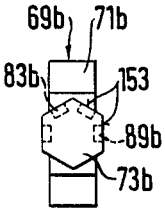
FIG. 6 shows an end view of the key according to FIG. 5.

FIGS. 5 and 6 show a variant of an electronic key which differs from the key according to FIG. 2 only in the form of its key shank **73*b*. Parts of like effect are designated with the reference numerals of FIG. 2 and additionally with the letter b. For more detailed explanation of the assembly and manner of operation of the electronic lock reference is made to the description of FIGS. 1 and 2. The electronic key 69***b* again comprises a key handle 71*b* which contains the store and control circuit 75*b*. The elongated shank 73*b* protruding from the handle 71 has the form of a regular, equal-sided hexagon in cross-section. At least on some of its side faces 153 the key 69*b* carries several pairs of light-emitting diodes 83*b* and photo-diodes 85*b* for data transmission and several photo-diodes 89*b* for energy supply. By reason of the greater number of faces and their more uniform width in the circumferential direction of the shank 73*b* the data and energy transmission elements can be arranged more favourably in construction.

Figure 7:
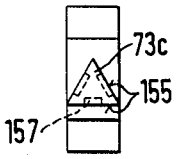
FIG. 7 shows an end view of a variant of the key according to FIG. 5.

FIG. 7 shows a variant of the key according to FIGS. 5 and 6 which differs from the key 69*b* only in that its shank 73*c* has the form of an equilateral triangle in cross-section. Again transmission elements for the data and energy transmission are arranged on the side faces 155 of the shank 73*c*, , as indicated at 157.

The reading device, not further illustrated in FIGS. 5 to 7, is assembled similarly to the reading device 77 in FIG. 1. The key passage has a cross-sectional form adapted to the cross-sectional form of the key shank. For controlling the direction of movement of the bolt at least one pair of piezo-electric elements is provided, of which one controls the unlocking direction and the other the locking direction. Both in the keys according to FIGS. 5 to 7 and in the keys according to FIGS. 2 and 4 however the key passage can be provided in a part similar to a lock cylinder mounted rotationally elastically about the longitudinal axis of the key shank, which part in turn controls the two piezo-electric elements for the opening direction and the locking direction respectively of the bolt.

Figure 8:
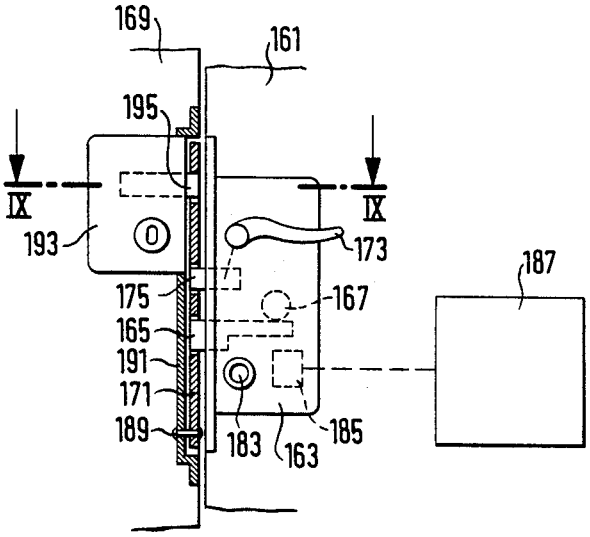
FIG. 8 shows a diagrammatic lateral elevation of another form of embodiment of an electronic key.
Figure 9:
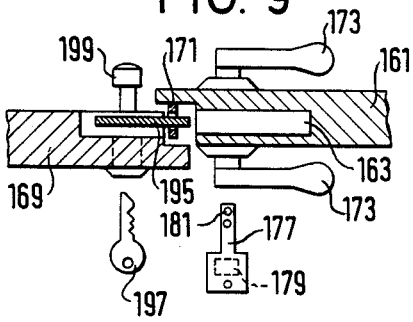
FIG. 9 shows a diagrammatic sectional view of the electronic key, seen along a line IX—IX in FIG. 8.

FIGS. 8 and 9 show another form of embodiment of an electronic door lock which differs from the above-explained variants essentially only in the configuration of the devices provided for the overlocking of the electronic door lock in case of emergency. The electronic door lock comprises a mortice lock 163 installed in a door 161, the bolt 165 of which lock is movable out to lock in a keep plate 171, held on a door frame 169, exclusively by means of an electro-motive drive 167, for example an electro-magnet or an electric motor. The lock 163 additionally comprises a latch bolt 175 actuatable in the usual way by door handles 173 and likewise engaging in the keep plate 171.

For the control of the bolt drive 167 an electronic key 177 is provided which however has no mechanical locking function for the bolt 165. The key 177 comprises a store and control circuit 179 which exchanges data with a store and control circuit 185 of the lock through infra-red data transmission elements 181 of the keys in two directions with infra-red data transmission elements (not shown further) of a reading device 183 of the lock. The store and control circuit 185 controls the bolt drive 167 in dependence upon a key word datum stored in the store and control circuit 179 of the key 177. The key 177 is again supplied with working voltage from the lock 163 by way of infra-red energy transmission or mechanical contacts. A circuit 185, which like the circuit 179 can be formed as micro-processor, can be connected to an alarm installation 187 or an access-monitoring installation.

In order that when the door 161 is electronically locked, in cases of emergency the door 161 may nevertheless be opened, the keep plate 171 is held pivotably by means of a pin 189 at its one end on a frame 191 of an additional mechanical lock 193, especially a cylinder lock, secured to the door post, so that it can be hinged away. The other end of the hingeble keep plate 171 is fixed to the door post by the bolt 195 of the mechanical lock 193. The lock 193 can be unlocked from the outside of the door by means of a mechanical key 197, and in the unlocked condition liberates the keep plate 171, so that the door 161 can be opened even if the bolt 165 is locked, in order for example to render possible access for the fire service. From the inside of the door the mechanical lock 19 can be unlocked by means of a door handle 199, so that an emergency exit function of the lock is ensured.

The key 177 can have the forms as explained above with reference to FIGS. 2 and 4 to 7. The reading device 183 can correspond to the reading devices 77 and 77*a* of FIGS. 1 and 3. Likewise it can be provided that the bolt drive 167 also drives the latch bolt 175 when the bolt 165 is unlocked.

Figure 10:
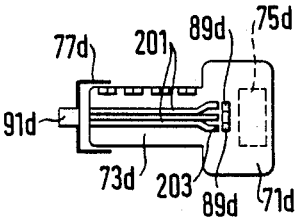
FIG. 10 shows a further variant of the key according to FIG. 5.

FIG. 10 shows a further variant of an electronic key for one of the above-explained electronic locks, especially the lock in FIG. 1. It differs from the key according to FIG. 2 essentially only in the nature of the working voltage supply. parts of like effect are therefore provided with the reference numerals of FIGS. 1 and 2 and for distinction with the letter d. For more detailed explanation of the assembly and manner of operation, reference is made to the description of FIGS. 1 and 2.

The energy supply of the store and control circuit 75*d* takes place optically, similarly to the key of FIG. 2. For this purpose in the reading device 77*d* of the lock a laser diode 91*d*, preferably only one single laser diode, is provided which illuminates the end face of a bundle of optical fibres 201 when the key is inserted into the reading device 77*d*. The optical fibres 201 end oppositely before a field of several photo-diodes 89*d* which are thus illuminated by the laser diode 91*d* for the working voltage generation. Since the photo-diodes 89*d* occupy comparatively much space, they are housed in the handle 71*d* of the key and the ends of the optical fibres 201 adjacent to the photo-diodes 89*d* diverge three-dimensionally. The ends 203 adjacent to the photo-diodes 89*d* illuminate the photo-diodes 89*d* by way of a diffusor or the like, which can be formed for example by the frosted end face of the optical fibres 201. The optical fibres extend preferably along the shank 73*d* of the key and lie free for the illumination by the laser diode 91*d*, at the end of the shank 73*d* remote from the key handle. However it is also possible to have the illuminating side of the optical fibres 201 emerge laterally from the shank 73*d*. The laser diode 91*d* is expediently an infra-red laser diode.

The electronic keys as explained above can also be used with other electronic locks in order that the advantage of their reliability may be exploited. To this extent independent inventive significance is attributable to the features directed to the electronic keys and especially the features directed to their data transmission and energy supply.

We claim:

1. Electronic door lock for an electronic key (69; 177) provided with an electronic store (75; 179) for a key word datum, having a latch bolt (5; 175) engaging in a keep plate (9; 171) and actuatable at least from the inside of the door by means of a handle, a bolt (7; 165) movable out into the keep plate (9; 171), an electrically controllable locking mechanism (35, 37; 167) for the bolt (7; 165), a reading device (77; 183) for the key word datum of the electronic key (69; 177) and a control circuit (81; 185) controlling the locking mechanism (35, 37; 167) in dependence upon the read key word datum, characterised in that the reading device (77) comprises a sensor device (93, 95) responding to two three-dimensionally different orientation of the electronic key (69; 177), one orientation being for locking, and the other being for unlocking, and in that the locker mechanism (35, 37; 167) comprises an electric drive device (35), controlled by the control circuit (81p; 185) for the unlocking and locking movement of the bolt (7; 165) and drives the bolt (7; 165) in dependence upon the orientation of the electronic key (69; 177) detected by means of the sensor device (93, 95), in the unlocking or in the locking direction.

2. Door lock according to claim 1, characterised in that the drive device (35) is in drive connection with the latch bolt (5) too and drives the latch bolt (5) in the opening direction when the orientation of the electronic key (69) allocated to the unlocking direction is detected by means of the sensor device (93, 95).

3. Door lock according to claim 2, characterised in that the drive device comprises a common electromotive drive element (35) which drives the bolt (7) through a first gear connection (37) and the latch bolt (5) through a second gear connection (63) and in that the second gear connection (63) comprises an idle-motion device (57, 59) which uncouples the latch bolt (5) from the drive element (35) when the bolt (7) is in the outward locking position.

4. Door lock according to claim 2 or 3, characterised in that the drive device comprises an electric motor (35) which drives the bolt (7) in thrust motion through a rack gearing (77).

5. Door lock according to claim 4, characterised in that the rack gearing (37) comprises a cam (57) which, on movement in the unlocking direction, drives the latch bolt (5) in the opening direction through a lever transmission (63).

6. Door lock according to claim 1, having a lock cylinder (113) lockable by means of a mechanical key and mechanically overlocking the bolt (7) independently of the control circuit (81), characterised in that a handle is also provided on the outside of the door and in that the bolt (7) is bringable alternately into a drive connection with the electric drive device (35) or a drive connection with the external handle through a coupling (49, 117) which can be changed over by means of the lock cylinder (113).

7. Door lock according to claim 6, having a handle nut (23) driving the latch bolt (5), characterised in that the handle nut (23) is connected with a toothed wheel (121), in that the drive device (35) drives the bolt (7) through a toothed-wheel gearing (37) having a plurality of toothed wheels (45, 49, 51) meshing with one another in a gear train, in that an intermediate toothed wheel (49) of the gear train is mounted on a guide part (117) movable radially of its rotation axis (115), which guide part holds the intermediate toothed wheel (49) in a first position in engagement with a toothed wheel (45) of the gear train drivable by the drive device (35) and in a second position in engagement with the toothed wheel (121) connected with the handle nut (23), and in that the guide part (141) is displaceable between the first and the second positions by means of the lock cylinder (113).

8. Door lock according to claim 7, characterised in that the guide part (117) is resiliently initially stressed in the direction of one of its positions, especially towards the second position, is displaceable into the other of its positions against the spring initial stress and blockable in this position, by means of the lock cylinder (113).

9. Door lock according to claim 6, characterised in that the outer handle has a spindle (127) mounted freely rotatably in the handle nut (23) and in that in the handle nut (23) a coupling pin (129) is guided displaceably radially of the spindle (127), which coupling pin is bringable by means of the lock cylinder (113) into a position coupling the spindle (127) fast in rotation with the handle nut (23).

10. Door lock according to claim 1, characterised in that the keep plate (171) is mounted movably in the opening direction of the door (161) on a lock frame (191) of a mechanical lock (193), especially a cylinder lock, in such a way that it is liberated for the movement in the opening direction when the mechanical lock (193) is unlocked and when the mechanical lock (193) is locked it is arrested by the bolt (195) of the lock (193).

11. Door lock according to claim 10, characterised in that the keep plate (171) is pivotably movably mounted on the lock frame (191).

12. Door lock according to claim 6, characterised in that with the lock (113) lockable by means of the mechanical key there is associated an alarm-giving contact (141) of an alarm installation (137), which triggers the alarm of the alarm installation (137) on mechanical overlocking of the bolt (7) independently of the closed position of the bolt (7) driven by the electric drive device (35).

13. Door lock, according to claim 1, characterised in that the electronic key (69) contains an electronic store and control circuit (75) and carries, on a part introducible into the reading device (7), especially the key shank (73), at least one infra-red light transmission element (83) for the transmission of the key word datum, with which there is associated in each case in the reading device an infra-red light reception element (87), and in that the electronic key (69) and the reading device (77) comprise mutually associated energy transmission elements (89, 91; 147, 149, 151) for the working voltage supply of the store and control circuit (7) of the key (69) introduced into the reading device (77).

14. Door lock according to claim 13, characterised in that the reading device (77) likewise comprises, for the transmission of data from the control circuit (81) of the lock to the store and control circuit (75) of the key (69), at least one infra-red transmission element (85), to which there is allocated, on the part (73) of the key (69) which can be introduced into the reading device (77), in each case an infra-red light reception element (87).

15. Door lock according to claim 14, characterised in that the electronic key (69) and the reading device (77) each comprise several infra-red light transmission elements and several infra-red light reception elements for the multi-bit parallel transmission of data and in that the reading device (77) comprises an arresting device (97) by means of which the key (69) is fixable in relation to the reading device (77), at least for the duration of the data transmission.

16. Door lock according to claim 15, characterised in that the arresting device (97) comprises an electro-magnet (111) which by means of its armature (109) fixes the key (69) in the reading device (77).

17. Door lock according to claim 16, characterised in that the energy transmission elements of the reading device (77) comprise at least one light transmission element (91) and the energy transmission elements of the key (69) comprise at least one light reception element (89), for optical energy transmission.

18. Door lock according to claim 17, characterised in that the reading device (77) comprises several light-emitting diodes (91), especially laser diodes, and the key (69) comprises several photo-diodes (89).

19. Door lock according to claim 17, characterised in that the reading device (77*d*) comprises a laser diode and the key comprises several photo-diodes (89*d*) which are illuminatable by way of a bundle of optical fibres (201) of the key.

20. Door lock according claim 19, characterised in that the bundle of optical fibres is accessible for illumination by the laser diode (89*d*) at the end of the key shank (73*d*) placed remotely from the handle (71*d*) of the key.

21. Door lock according to claim 20, characterised in that the photo-diodes are arranged side by side transversely of the fibre longitudinal direction and in that the optical fibres (201) diverge from one another in the region of their ends facing the photo-diodes.

22. Door lock according to claim 21, characterised in that the photo-diodes are accommodated in the handle (71*d*) of the key.

23. Door lock according to claim 16, characterised in that the energy transmission elements of the key (69*a*) are formed as contact paths (147) elongated in the longitudinal direction of the part (73*a*) of the key to be introduced into the reading device, with which there are associated contact springs (151) and/or contact brushes (149) of the reading device (77*a*) which are preferably likewise elongated in the longitudinal direction of the contact paths (147) of the key (69*a*).

24. Door lock according to claim 23, characterised in that the key (69*b*) comprises a handle (71*b*) formed as housing for the store and control circuit (75*b*) and a shank (73*b, c*) introducible into the reading device, with a cross-section substantially in the form of an equal-sided polygon, the elements for data transmission (83*b*, 85*b*) and the energy transmission elements (89*b*) being arranged on the polygon faces of the shank (73*b*).

25. Door lock according to claim 24, characterised in that the shank (73*b*; 73*c*) has a substantially triangular or hexagonal cross-section.

26. Door lock according to claim 1, characterised in that the part (73) of the key (69) to be introduced into the reading device (77) has, at least in the region of the sensor device, a cross-section departing from the circular form, and in that the sensor device comprises at least two pressure-sensitive elements (93, 95), especially piezo-electric elements, which are arranged with angular spacing from one another around the non-circular part (73) of the key (69), in such a way that they can be charged with pressure in opposite directions of rotation of the key (69).

27. Door lock according to claim 26, characterised in that the key (69) is formed as a flat key and directly pressure-loads the pressure-sensitive elements (93, 95) with the flat sides of its shank (73).

28. Door lock according to claim 1, characterised in that the control circuit (81) is connected to an alarm installation (137) primable and unprimable by means of a block lock (144), which installation on priming of the block lock (144) controls the drive device (35) of the bolt (7) in the locking direction and on unpriming of the block lock (144) controls the drive device (35) in the opening direction.

29. A locking arrangement comprising several locks, including first locks having mechanical tumblers, the first locks being lockable by means of mechanical keys which each have a key shank provided with mechanical locking codes (143) so as to be interactable with the mechanical tumblers of the first locks, and second locks having latch bolts (7) actuatable by electromotor drives (35), so as to be movable into and out of the second locks, and electronic reading apparatus (91) for electronic locking codes stored on electronic keys (69) which contain an electronic memory and control circuit (75), each of the electronic keys having a key shank (73) which is insertable into the electronic reading apparatus (91), each key shank (73) having at least one first infrared transmitting element (83) for transmitting an electronic locking code, the reading apparatus having one first infrared light receiving element (87) assigned respectively to the infrared transmitting element (83), the key shank (73) further having a second infrared light receiving element (89) for optical energy transmission of an operating voltage supply for the electronic memory and control circuit (75), and the reading apparatus having at least one second infrared light transmitting element (91) assigned to the second infrared light receiving element (89), at least one of the electronic keys (69) including mechanical as well as electronic locking codes for locking at least one first and at least one second lock.

30. A locking arrangement according to claim 29, and further comprising a central monitoring apparatus (137) connected to the reading apparatus (91) of the second locks so as to store axis control information for the electronic locking codes specifically assigned to the second locks and control the latch bolt electromotor drives (35) depending on the read-out electronic locking code and the axis control information assigned to the read-out electronic locking code, the second locks being manually overrideable from a side secured by the lock, and still further comprising locking state signaling arrangements (141), (142) connected with the central monitoring apparatus (137), and an alarm installation which is triggerable by the central monitoring apparatus (137) if a locked second lock is opened from the secured side.

* * * * *